United States Patent [19]

Nell

[11] Patent Number: 4,778,534

[45] Date of Patent: Oct. 18, 1988

[54] METHOD FOR CLEANING PAINT ROLLERS

[76] Inventor: Warren E. Nell, 1811 Centre, Artesia, N. Mex. 88210

[21] Appl. No.: 733,979

[22] Filed: May 15, 1985

Related U.S. Application Data

[63] Continuation-in-part of Ser. No. 632,007, Jul. 18, 1984, abandoned, which is a continuation-in-part of Ser. No. 573,638, Jan. 25, 1984, abandoned.

[51] Int. Cl.[4] ..... B08B 3/04

[52] U.S. Cl. ..... 134/32; 134/38; 134/137; 134/182

[58] Field of Search ..... 68/213; 134/33, 38, 134/137, 138, 139, 141, 143, 149, 152, 153, 154, 155, 157, 166 R, 166 C, 170, 182, 199

[56] References Cited

U.S. PATENT DOCUMENTS

| | | | |
|---|---|---|---|
| 2,985,178 | 5/1961 | Christensen, Jr. | 134/149 |
| 3,421,527 | 1/1969 | Dettman | 134/182 X |
| 4,126,484 | 11/1978 | Monteiro | 134/38 X |

*Primary Examiner*—Philip R. Coe

*Attorney, Agent, or Firm*—Wendell Coffee

[57] ABSTRACT

A device is provided for easily and efficiently washing a water-based paint from a paint roller laden with such paint. The device is comprised of a circular cylindrical jacket held by a base cup having a closed lower extremity. An entrance channel penetrates said cup and jacket adjacent the closed lower extremity of the cup. A threaded coupling is associated with the cup in alignment with the entrance channel. In operation, a garden hose is coupled to the device and caused to direct a flow of water through the entrance channel and into the jacket. Said flow caused paint to be flushed from a roller inserted into the jacket.

2 Claims, 1 Drawing Sheet

METHOD FOR CLEANING PAINT ROLLERS

RELATED APPLICATIONS

This is a continuation-in-part application based upon application Ser. No. 632,007, filed July 18, 1984, and now abandoned; which was a continuation-in-part application based upon application Ser. No. 573,638, filed Jan. 25, 1984, and now abandoned.

BACKGROUND OF THE INVENTION

This invention concerns the cleaning of paint-applicator rollers, and more particularly related to a device for removing water-based paint from paint-applicator rollers.

Rollers are widely used for the application of paint to surfaces, particularly flat surfaces where it is desired to avoid the appearance of stroke marks that would result from the use of a paint brush. Water-based paints, comprised of latex of a synthetic polymer such as polyvinyl acetate, enjoy widespread popularity because they are free of volatile, flammable solvents, and permit easy paint removal with water prior to the drying of the paint.

The rollers are comprised of open-ended tubes having a cylindrically shaped rigid wall and an exterior porous layer attached to the rigid wall. The porous layer may be an open-celled synthetic foamed polymer or a fibrous composition of appreciable thickness. The roller is adapted for use with a holder comprised of a handle position and a swiveled mounting portion which insertively engages the roller.

A roller which is laden with water-based paint can be rinsed with water prior to the drying of the paint. The rinsing will remove the paint and restore the roller almost to its original condition, thereby permitting reuse of the roller. To facilitate the rinsing operation, a number of devices have earlier been disclosed. In general, such devices utilize water from a garden hose, causing the water to impinge upon the roller, and further provide a housing to minimize inadvertent splashing of the removed paint, then diluted by the rinse water.

Such prior devices, however, have either been inefficient in their operation, difficult to use, or of expensively complex design.

It is accordingly an object of the present invention to provide a device for cleaning paint rollers in an efficient manner utilizing a stream of water delivered from a flexible hose.

It is another object of this invention to provide a device of the foregoing object which may be easily used to clean rollers which are still mounted on their holders.

It is a further object of the invention to provide a device of the aforesaid nature which will prevent the inadvertent splashing of paint removed from the roller.

It is still another object of the present invention to provide a device of the aforesaid nature of simple and rugged construction which may be economically manufactured.

These objects and other objects and advantages of the invention will be apparent from the following description.

SUMMARY OF THE INVENTION

The above and other beneficial objects and advantages are accomplished in accordance with the present invention by an improved device for cleaning paint rollers by a flushing action comprising:

(a) a rigid elongated jacket cylindrically configured about a center axis, having an open upper extremity, and further defined by interior and exterior surfaces, (b) a base cup which fixedly receives the lower extremity of said jacket, said base cup being closed at its lower extremity by a flat panel perpendicularly disposed to the axis of said jacket, (c) an entrance channel which penetrates said jacket and base cup adjacent said flat panel in a direction such that the axis of said channel substantially perpendicularly intersects the axis of said jacket, and (d) threaded coupling means affixed to the exterior of said cup in alignment with said entrance channel.

In a preferred embodiment of the present invention, the jacket and base cup are fabricated of pipe stock, particularly pipe made of rigid polyvinylchloride. The several components are preferably fixedly joined by adhesives in a manner to prevent fluid leakage at the joints. In a still further embodiment, the entire device may be fabricated an an integral monolithic structure by a molding operation utilizing a suitable engineering grade synthetic plastic.

The interior diameter of the jacket will range from 1½ to 2 inches and is adapted to permit close-fitting insertion of paint rollers of standard dimensions. The height of the jacket will accordingly range from about 8 to 10 inches so that paint rollers of standard dimensions can be completely inserted into the jacket. The threaded coupling means is preferably a female fitting constructed to accommodate a standard garden hose male fitting.

In operation, a stream of water from a garden hose enters the jacket, surrounds the roller, and flushes paint from the roller and out of the jacket. The device may be held in a manner such that the open upper extremity of the jacket is directly upwardly, downwardly, or in other directions.

BRIEF DESCRIPTION OF THE DRAWING

For a fuller understanding of the nature and the objects of the invention, reference should be had to the following detailed description taken in connection with the accompanying drawing forming a part of this specification and in which similar numerals of reference indicate correponding parts in all the figures of the drawing.

Figure 1:
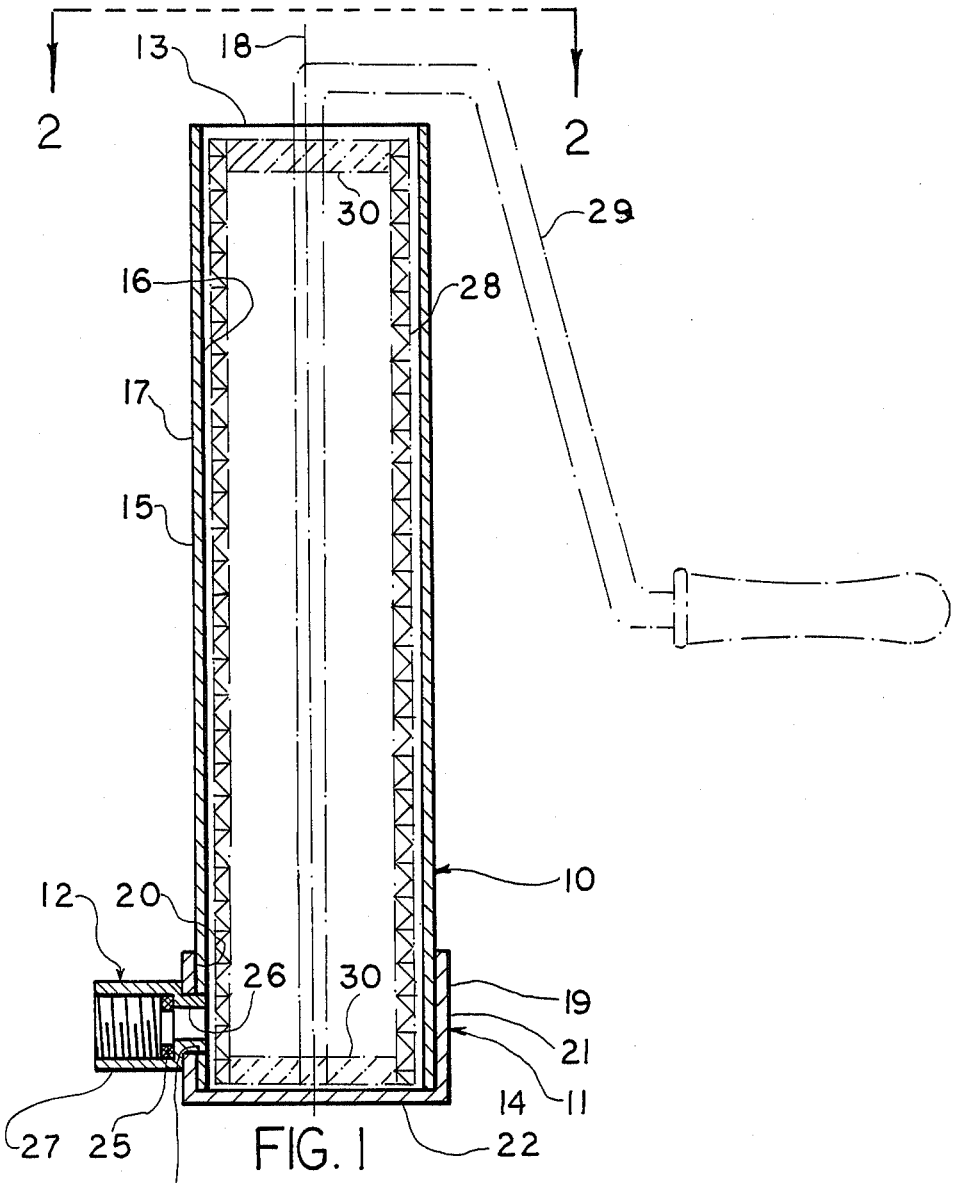
FIG. 1 is a sectional side view of an embodiment of the device of the present invention shown in functional emgagement with a paint roller.

For convenience in description the terms "upper" and "lower", or words of similar import, will have reference to the upper and lower extremities of the device appearing in FIG. 1.

DETAILED DESCRIPTION OF THE INVENTION

Figure 2:
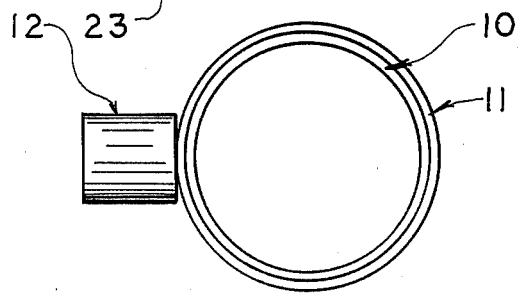
FIG. 2 is a top view of the embodiment of FIG. 1 without the paint roller.

Referring to FIGS. 1 and 2, a device of the present invention is shown comprised of elongated jacket 10 held by base cup 11 having coupling 12 affixed thereto.

Jacket 10 is comprised of open upper extremity 13, lower extremity 14 and circular cylindrical sidewall 15 defined by concentric interior and exterior surfaces 16 and 17, respectively, symmetrically disposed about center axis 18. Said upper and lower extremities are of circular contour and disposed in parallel planes perpendicularly disposed to axis 18.

Base cup 11 is comprised of circular cylindrical sidewall 19 defined by concentric interior and exterior surfaces 20 and 21, respectively, and flat closure panel 22 disposed perpendicularly to axis 18 at the lower extremity of said base cup. Jacket 10, having an outside diameter slightly smaller than the inside diameter of said base cup, is inserted into the base cup and bonded to interior surface 20 thereof in fluid impervious manner. Said bonding may, in the case of plastic materials of construction, be achieved with polymeric adhesives. If the jacket and base cup are of metal construction, the bonding may be secured by brazing, soldering, welding or analogous techniques utilizing molten metal sealants.

A circularly shaped channel 23 having a uniform circular cross section extends through the curved sidewalls of the interengaged jacket and base cup. The center axis of said channel is such as to perpendicularly intersect axis 18.

Coupling 12, a female threaded fitting comprising stem portion 26 and external portion 27, is held within channel 23 by fluid impervious bonding. A resilient washer 25 is positioned within said coupling to facilitate leak-free joinder with a male fitting of a hose such as a standard garden hose. Although coupling 12 has been exemplified as being of a substantially fixed, monolithic structure, other embodiments may permit external portion 27 to rotate about stem portion 26.

In using the device a garden hose is attached to coupling 12, and water flow is initiated. The roller 28 of a paint roller device with bent metal rod holder 29 and rotative end fittings 30, is inserted into jacket 10 into abutting contacting with flat closure panel 22. The flow of water in the annulus surrounding the roller flushes water-dispersible paint out of the roller and out of the device. During the washing operation, the device may be hand-held or otherwise held in any position, the effluent being directed toward proper disposal means.

By manually and cyclically forcing the roller downward, a pumping effect or churning is established. The churning causes a flushing action which more effectively removes paint from the roller.

The tighter the roller fits within the jacket, the better and faster the flushing and cleaning process will occur. Because of this tight fit, when the roller is first inserted into the jacket, there may be a spray of water from the top of the roller. Therefore, it is advantageous to cover the end of the roller with a paper towel to shield against this spray.

After the paint has been flushed from one end, the roller is removed from the jacket and the roller is removed from the holder. The roller is reversed on the holder. With the roller reversed, it is again inserted into the jacket, again using a paper towel to shield against any spray. The roller is again churned within the jacket until both ends are flushed clean of paint.

Thereafter, the excess water may be shaken from the roller and the roller either used for another color paint or stored.

While a particular example of the present invention has been shown and described, it is apparent that changes and modifications may be made therein without departing from the invention in its broadest aspects. The aim of the appended claims, therefore, is to cover all such changes and modifications as fall within the true spirit and scope of the invention.

I claim as my invention:

1. The method of cleaning a paint roller mounted on a bent metal rod holder by rotative end fittings comprising the steps of:

a. inserting the roller attached to the holder completely into an open end of a rigid elongated cylindrical jacket, the jacket having an interior diameter closely fitting the paint roller, b. flowing water into a closed end of the jacket, the closed end being opposite the open end, thereby c. flowing water through the annular space between the roller and the jacket, and d. churning the roller by moving the rod holder up and down while flowing the water into the jacket.

2. The invention as defined in claim 1 further comprising:

e. removing the roller from the jacket, f. reversing the roller upon the holder, g. then repeating the steps a. through d. above.

* * * * *